US006402270B1

(12) United States Patent
Frank

(10) Patent No.: US 6,402,270 B1
(45) Date of Patent: Jun. 11, 2002

(54) DISPLAY CABINETS AND HINGES THEREFOR

(75) Inventor: Manfred Johannes Frank, Auckland (NZ)

(73) Assignee: Group D'Etoile Limited, Palmersion North (NZ)

( * ) Notice: Subject to any disclaimer, the term of this patent is extended or adjusted under 35 U.S.C. 154(b) by 0 days.

(21) Appl. No.: 09/485,642

(22) PCT Filed: Aug. 11, 1998

(86) PCT No.: PCT/NZ98/00118

§ 371 (c)(1),
(2), (4) Date: Feb. 11, 2000

(87) PCT Pub. No.: WO99/07260

PCT Pub. Date: Feb. 18, 1999

(30) Foreign Application Priority Data

Aug. 11, 1997 (NZ) ..... 328532
Jan. 13, 1998 (NZ) ..... 329577

(51) Int. Cl.[7] ..... A47F 3/00

(52) U.S. Cl. ..... 312/138.1; 312/326; 16/366; 16/370

(58) Field of Search ..... 312/325, 326, 312/327, 328, 329, 138.1, 114, 126, 140, 351; 16/370, 366

(56) References Cited

U.S. PATENT DOCUMENTS

| | | | | | |
|---|---|---|---|---|---|
| 694,987 | A | * | 3/1902 | Pollard | 312/114 X |
| 891,021 | A | * | 6/1908 | Wadsworth | 312/117 |
| 2,266,580 | A | * | 12/1941 | Alheit | 312/140 X |
| 4,817,241 | A | * | 4/1989 | Koch et al. | 16/370 X |

FOREIGN PATENT DOCUMENTS

| | | |
|---|---|---|
| AT | 295141 | 12/1966 |
| AT | 28444/67 | 4/1969 |
| DE | 29709806 | 7/1997 |

* cited by examiner

*Primary Examiner*—Jose V Chen
*Assistant Examiner*—Hanh V. Tran
(74) *Attorney, Agent, or Firm*—Blakely Sokoloff Taylor & Zafman LLP

(57) ABSTRACT

A hinge for the mounting of a closure panel to a display cabinet. The hinge has a panel mounting member (11) to which is pivotally mounted (19) an arm (16). A second arm (12) is pivotally coupled (15) to a fixture mounting member (10). The arms (12 and 16) cross over and are joined by a pivot (20). A link (22 and 22*a*) which is adjustable in length is coupled between an extension (21, 21*a*) of the arm (12, 16) and the mounting member (10, 11) opposite to that to which the arm (12, 16) is pivotally connected.

27 Claims, 12 Drawing Sheets

DISPLAY CABINETS AND HINGES THEREFOR

BACKGROUND OF THE INVENTION

The present invention relates to display cabinets and a hinge whereby a closure can be moved between open and closed positions relative to an opening.

The hinge of the present invention is more particularly intended for the opening and closing of a closure of a display cabinet or case of a type typically found, for example, in a museum or similar display environment. More particularly, the hinge is intended for the controlled opening and closing of a heavy glass panel forming part of the display case.

Traditionally, problems have arisen when mounting a heavy glass panel designed for opening and closing action, not only as a result of the weight of the panel but also to ensure that the panel can be moved between open and closed positions without damage to dust seals or the like, adjacent panel(s) and to tightly fit within the opening and more particularly engage with dust seals.

SUMMARY OF THE INVENTION

An object of the present invention is to provide a hinge for mounting a closure panel which achieves or goes some way to achieving the aforementioned desired characteristics or to at least give the public a useful choice.

Broadly, according to one aspect of the invention, there is provided a hinge comprising a panel mounting element and a fixture mounting element, a first arm pivotally mounted to the panel mounting element and a second arm pivotally mounted to the fixture mounting element, the first and second arms being pivotally joined together by pivot means and adjustment means coupling each arm to the mounting element opposite to that to which it is pivotally coupled.

According to a second broad aspect there is provided a display cabinet including a closure panel, a pair of hinges mounting said closure panel such that the closure panel can be moved between open and closed positions each said hinge having a panel mounting element coupled to the closure panel and a fixture mounting element coupled to a fixture, the mounting elements being coupled together by first and second arms, said mounting elements having a pair of projecting flanges between which said arms are pivotally coupled.

DESCRIPTION OF PREFERRED EMBODIMENTS OF THE INVENTION

Figure 1:
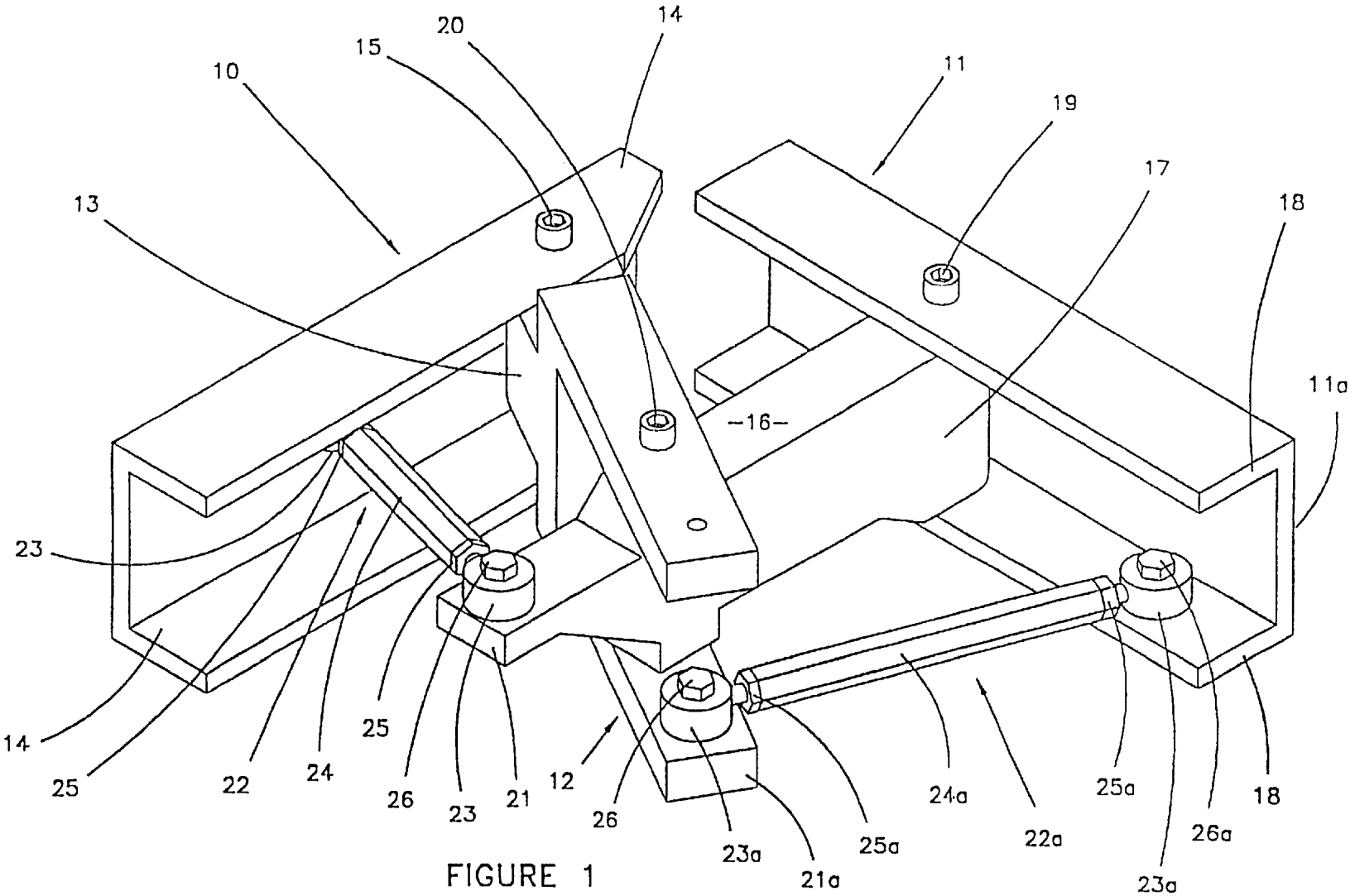
FIG. 1 is a perspective view of the hinge in a closed position.
Figure 2:
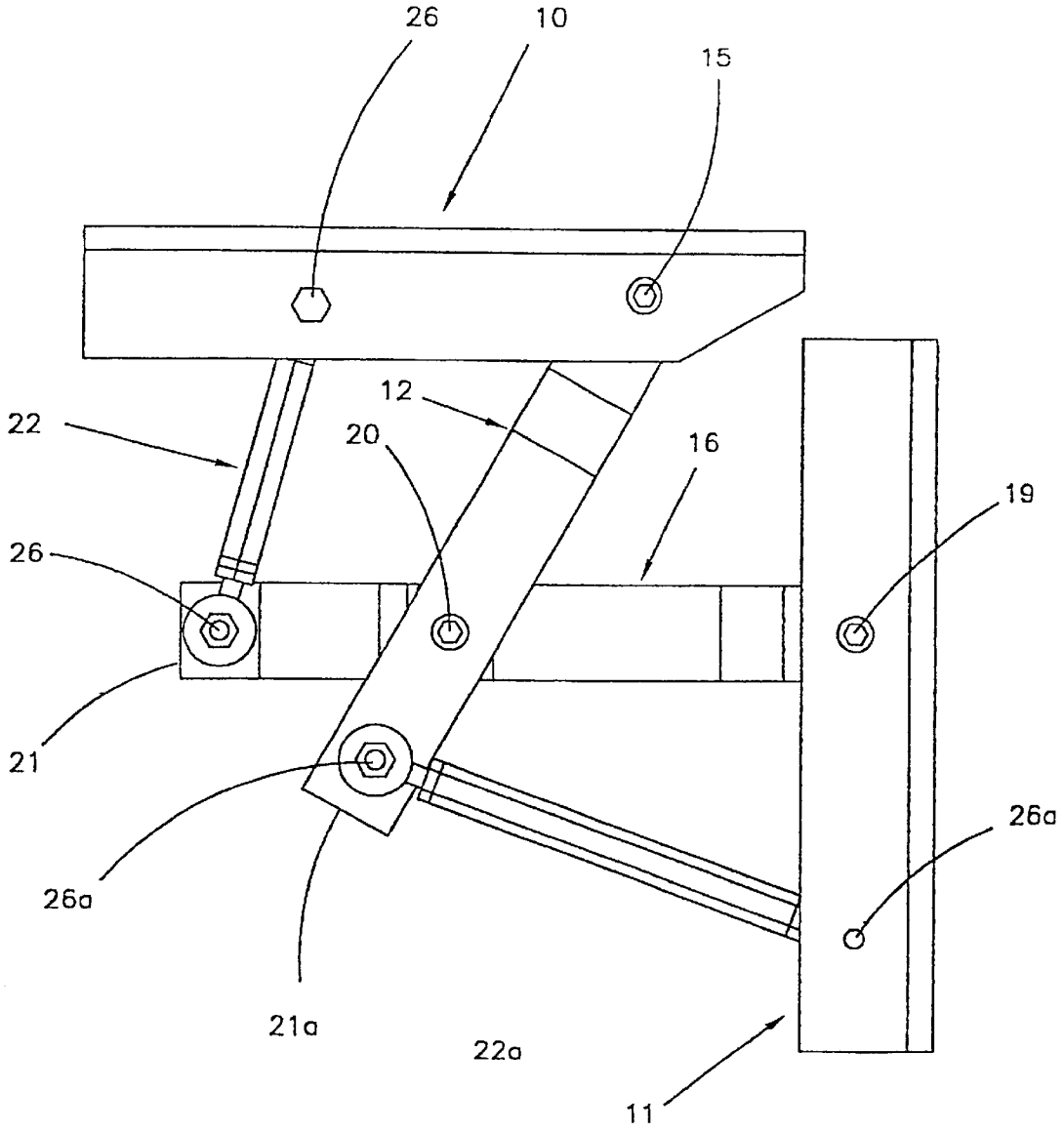
FIG. 2 is a plan view of the hinge shown in FIG. 1.
Figure 3:
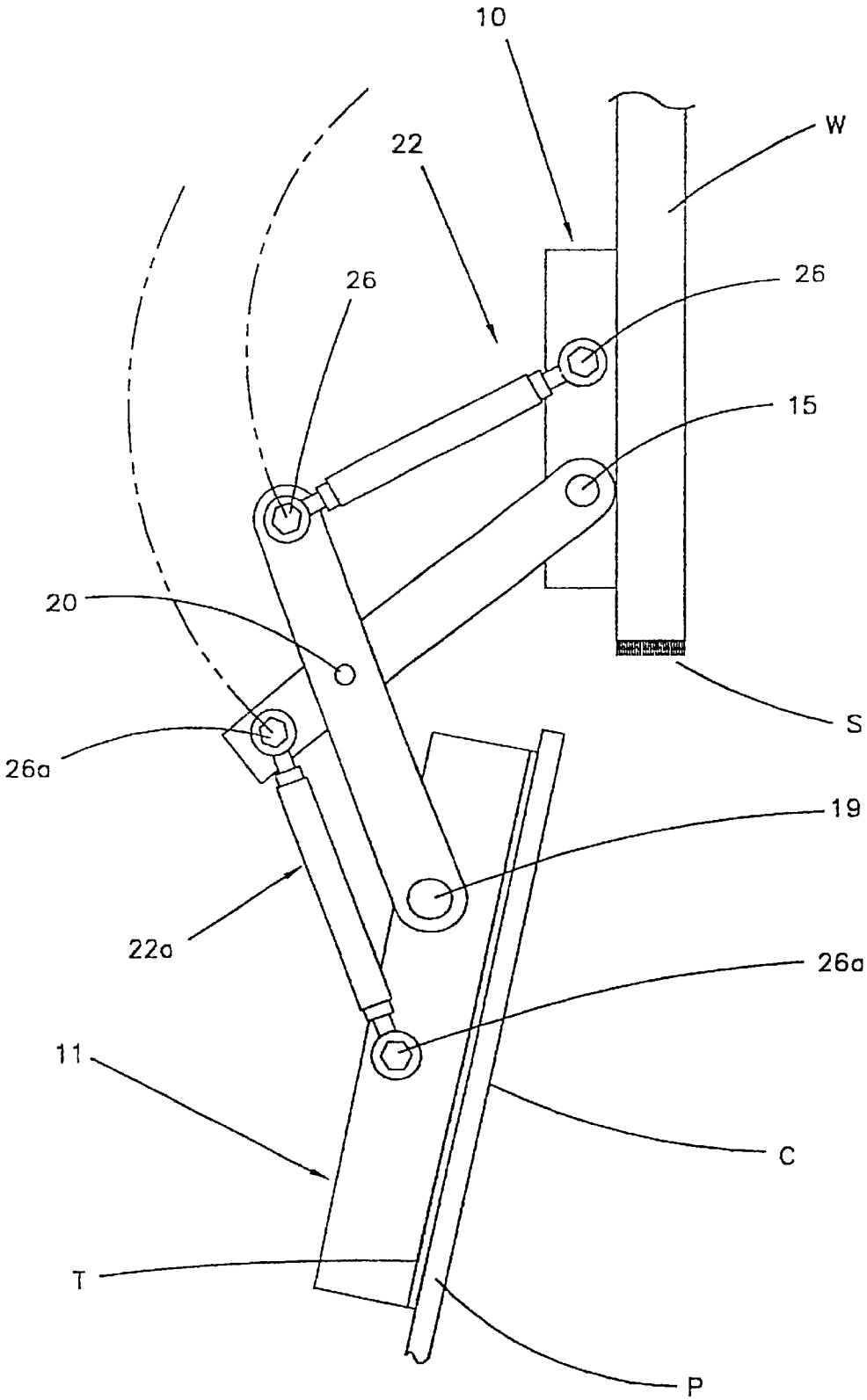
FIG. 3 is a plan view of the hinge showing the geometry thereof when in an open position.
Figure 4:
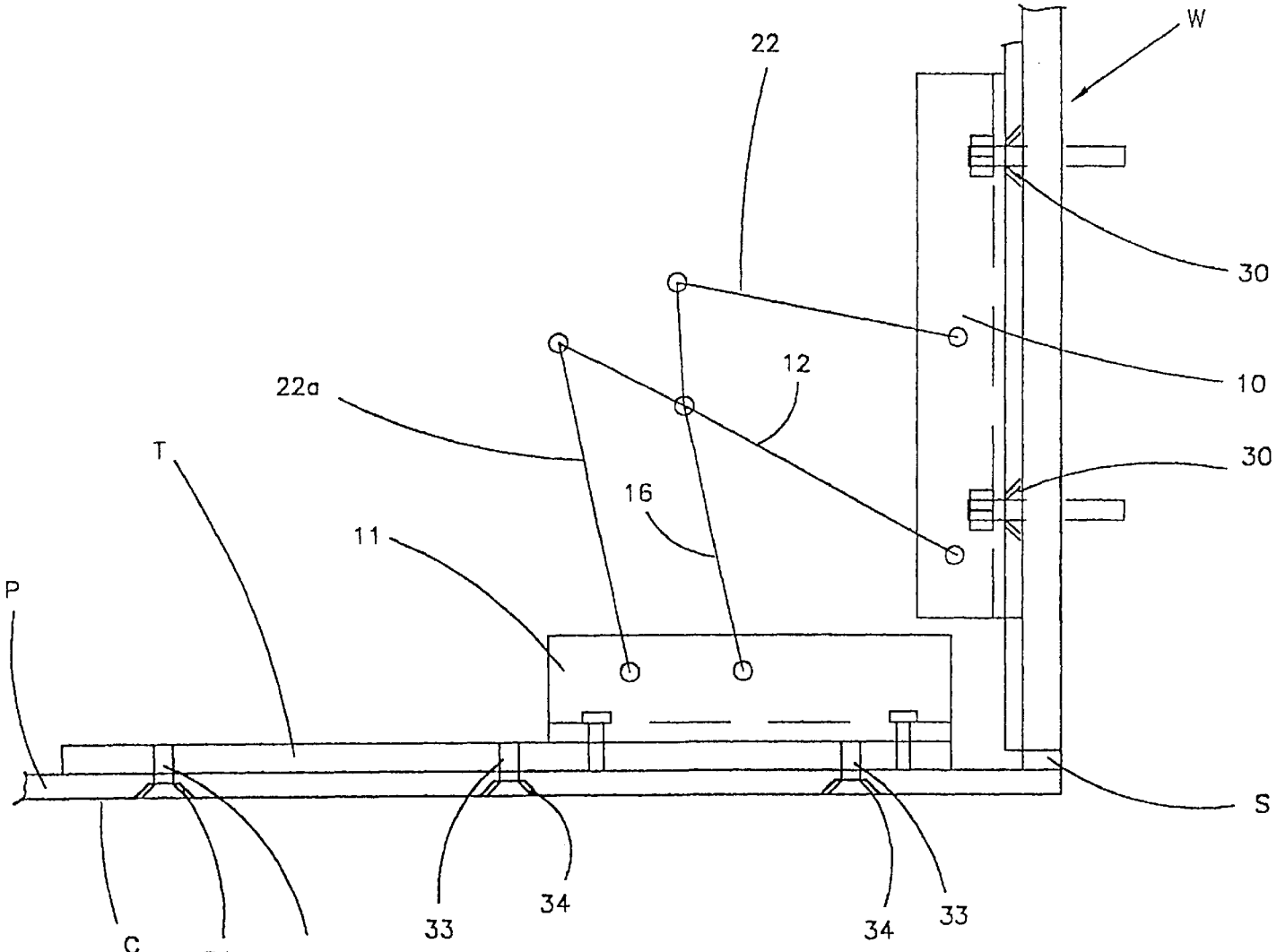
FIG. 4 is a plan view of a second embodiment of the geometry of the hinge with the hinge in situ in a display case.

The hinge according to the present invention consists of a frame mounting plate 10 which in the illustrated form is of channel section. The frame mounting member 10 is provided with suitable openings (not shown) whereby it can be attached to, say, the frame, case or a wall forming part of a display case construction. If the wall of the display case is a glass panel, then frame mounting member 10 can be mounted thereto in the manner referred herein regarding mounting of a closure panel to the panel mounting member 11.

The panel mounting member 11 is according to the illustrated form of the invention also preferably of channel section. As will hereinafter be described, this panel mounting member 11 also includes openings (not shown) for mounting thereto of a glass panel.

Pivotally mounted to the frame mounting element 10 is an arm 12 which has a mounting end 13 fitted between the flanges 14 of the frame mounting member 10. A pivot axle 15 (shown in the illustrated form as a cap screw) extends through aligned openings in the mounting portion 13 and flanges 14 to pivotally mount the arm 12 with the frame mounting member 10.

An arm 16 having a mounting end 17 is similarly mounted between flanges 18 of the panel mounting member 11 by a pivot 19 (eg a cap screw). Arm 16 locates between fingers of a bifurcated portion of arm 12 and is pivotally coupled thereto by a pivot 20 which in the illustrated form of the invention can also be formed by a cap screw. With all three pivots 15, 19 and 20 as illustrated, the threaded end of the cap screw can engage in a threaded opening in the opposing flange 14 and 18 in the case of mounting members 10 and 11 and the opposing finger part of the arm 12.

It will be appreciated, however, by those skilled in the art that this is only one example of a pivot mounting and others will be suitable. Preferably, the pivot mounting is one which does not loosen or tighten up with repeated operation, eg pivot pins located top and bottom by circlips or simply pins dropped into aligned bores. Also, the pivot mounting can have a level of friction to hold or assist in holding the panel open when moved to an open position.

According to one preferred form of the invention the arms 12 and 16 can be of cast metal construction and preferably of spheroidal graphite (SG) cast iron. Such material exhibits desirable strength and bending characteristics suitable for carrying the heavy glass panels for which the hinge is intended. Also in the preferred form, hardened nitrated steel pins are employed to pivotally couple the arms where they cross over and at the inter-connection with the mounting members 10 and 11. The combination of the nitrated steel pins as the pivot pins and the SG cast iron results in little or no lubrication at the pivot bearings being required. Optionally, wear resistant and self-lubricating bushes/washers could be provided at the pivot coupling of the arms to the mounting members so as to prevent metal to metal contact between the arms and the mounting members. However, in practice, it is found that this is not necessary.

In the preferred form of the invention, the mounting members 10 and 11 are of extruded alloy construction.

The distal end 21 of arm 16 is coupled to one of flanges 14 of the frame mounting member 10 by an adjustable link 22. This link 22 is a typical length adjustable link having ball unions 23 with threaded stub shafts thereof engaged in threaded link element 24. In a typical arrangement of such an adjustable link there are also provided lock nuts 25 so that after link element 24 has been rotated to achieve the required distance between the pivot axis defined by pivot mounts 26 joining the unions 23 to the distal end 21 and flange 14 the lock nuts 25 can be tightened to lock the link 22 in its adjusted position.

Similarly, a link 22*a* is mounted between a flange 18 of panel mounting member 11 and distal end 21*a* of a finger of arm 12.

In the preferred form of the invention the panel mounting member 11 is provided with a plurality of threaded openings 27 (see FIG. 5) in the base of the channel shape. A plate T is mounted in the appropriate position on the glass panel P (e.g. hard up to the top edge or to the bottom edge) and fastened thereto by threaded fastenings 33 extending through openings 34 in the glass panel and into aligned threaded openings 35 of the plate T. In the preferred form of the invention fiber washers or the like or a spacer (not shown) are positioned between the plate T and the glass panel P.

The panel mounting member 11 can then be suitably fastened to the plate T by also engaging threaded fasteners through openings 27 in the base of the member 11 and into other of the threaded openings 28 in the plate. It will be appreciated by those skilled in the art that prior to the mounting of the glass panel P to the panel mounting member 11 the frame mounting member 10 will be attached by fasteners 30 to a frame, wall or similar fixture W of the display case at right angles to the plane of the opening to be closed by the glass panel. It will also be appreciated by those skilled in the art that a hinge according to the present invention will be mounted top and bottom, eg in a manner similar to a casement type window. Also, the hinge at the top of the panel may be heavier (ie sturdier) in construction that the hinge for the bottom of the panel due to the higher load to be carried by the top hinge.

To disguise from the outside of the display case the presence of the hinges, it is preferred in one form of the invention that a thin cover plate C (which can be of aluminium construction) is applied along the outer surface at top and bottom of the glass panel P to cover at least the width from the edge inwards of the panel occupied by the panel mounting member 11. This cover plate C can be applied by any suitable adhesive though in one form of the invention this is a double-sided adhesive tape. Other arrangements can, of course, be used such as a masking painted strip along the top and bottom of the panel for a width at least equal to the width of the channel panel mounting element 11.

With the panel mounted by the hinges top and bottom, adjustable links 22 and 22*a* can be adjusted in a conventional manner by loosening lock nuts 25 and 25*a* and then rotating the link element 24 and 24*a*. The longer link 22*a* enables adjustment of the amount of pressure applied by the panel on dust seals located about the periphery of the closure to ensure that when the panel is in the closed position sufficient pressure is applied to the dust seals to ensure a good dust tight seal about the periphery of the opening.

The shorter adjustable link 22 of the upper and lower hinges are adjusted top and/or bottom so as to adjust the alignment of the glass relative to the vertical line of the sides of the opening and/or an adjacent edge of a panel of an adjacent display case where the panel closes the opening of a display case immediately adjacent another display case.

Figure 12:
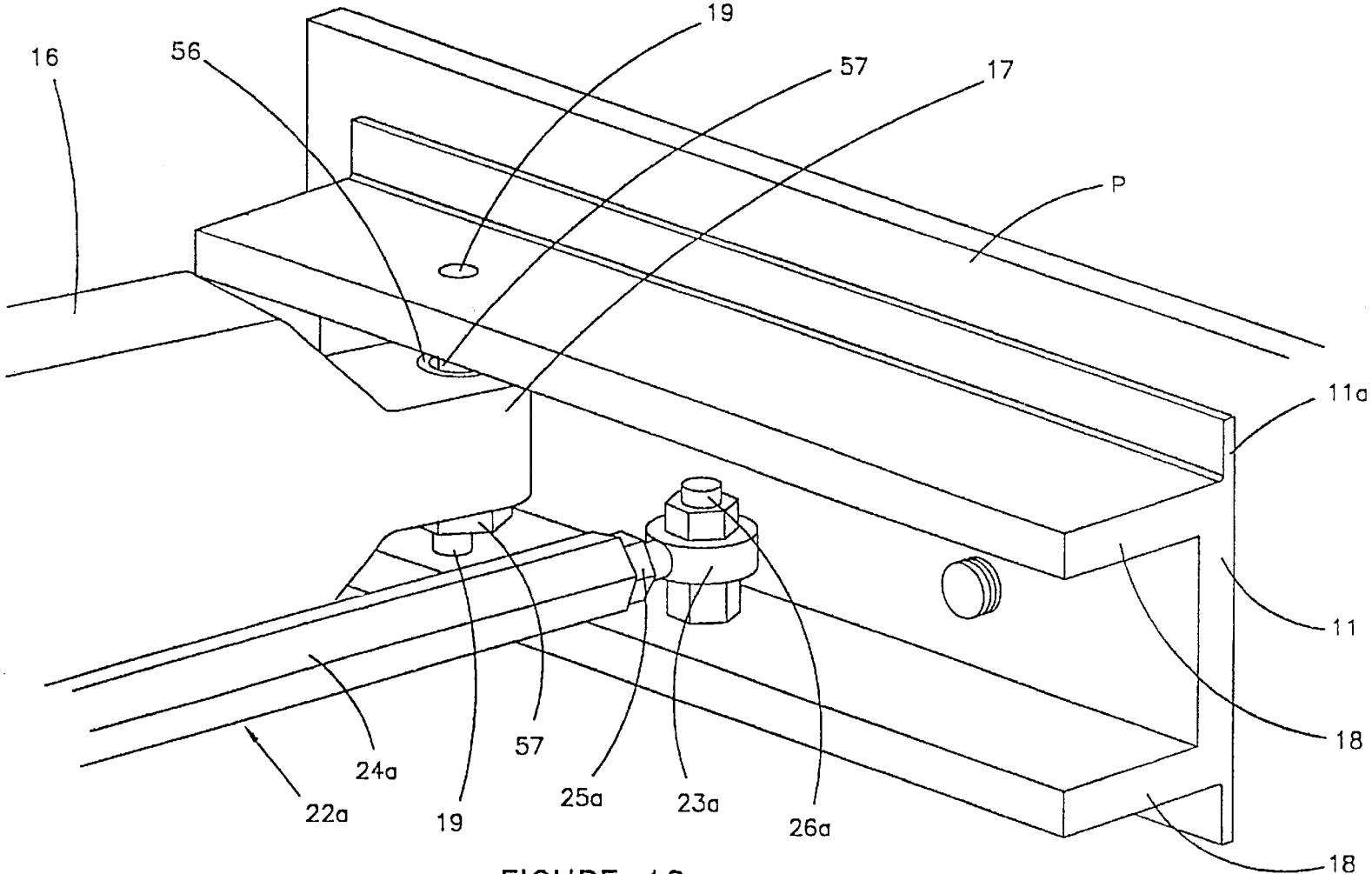
FIG. 12 is a part view showing a form of joining an arm to its associated mounting member.

According to one form of the invention (see FIG. 12) a spherical bearing (not shown) is located within a bore 56 in mounting end 17 through which the pivot pin 19 engages. Located either side of the bearing is a threaded lock nut 57 through which the threaded shank of pivot 19 engages. Thus, when the pivot 19 is threaded fully into place it passes through both the lock nuts 57 and the spherical bearing.

The presence of the spherical bearing enables the panel mounting member 11 to be adjusted in position relative to the mounting end 17. It will be noted that in this embodiment mounting end 17 does not extend fully between the flanges 18 of the channel shaped mounting member 11. This results in the mounting member 11 being able to be adjusted so as to make allowance for, say, the frame, case or a wall to which the frame mounting plate 10 is attached not being "square" to the opening, e.g. out of vertical alignment. This also ensures that no undue stresses are applied to the glass panel.

Once the glass panel mounted top and bottom by the mounting member 11 of the upper and lower hinges has been correctly aligned, as permitted by the adjustment effect of the spherical bearings, the lock nuts of at least one hinge (though generally of both hinges) are tightened up against the spherical bearing to thereby hold the panel in its adjusted position.

Figure 5:
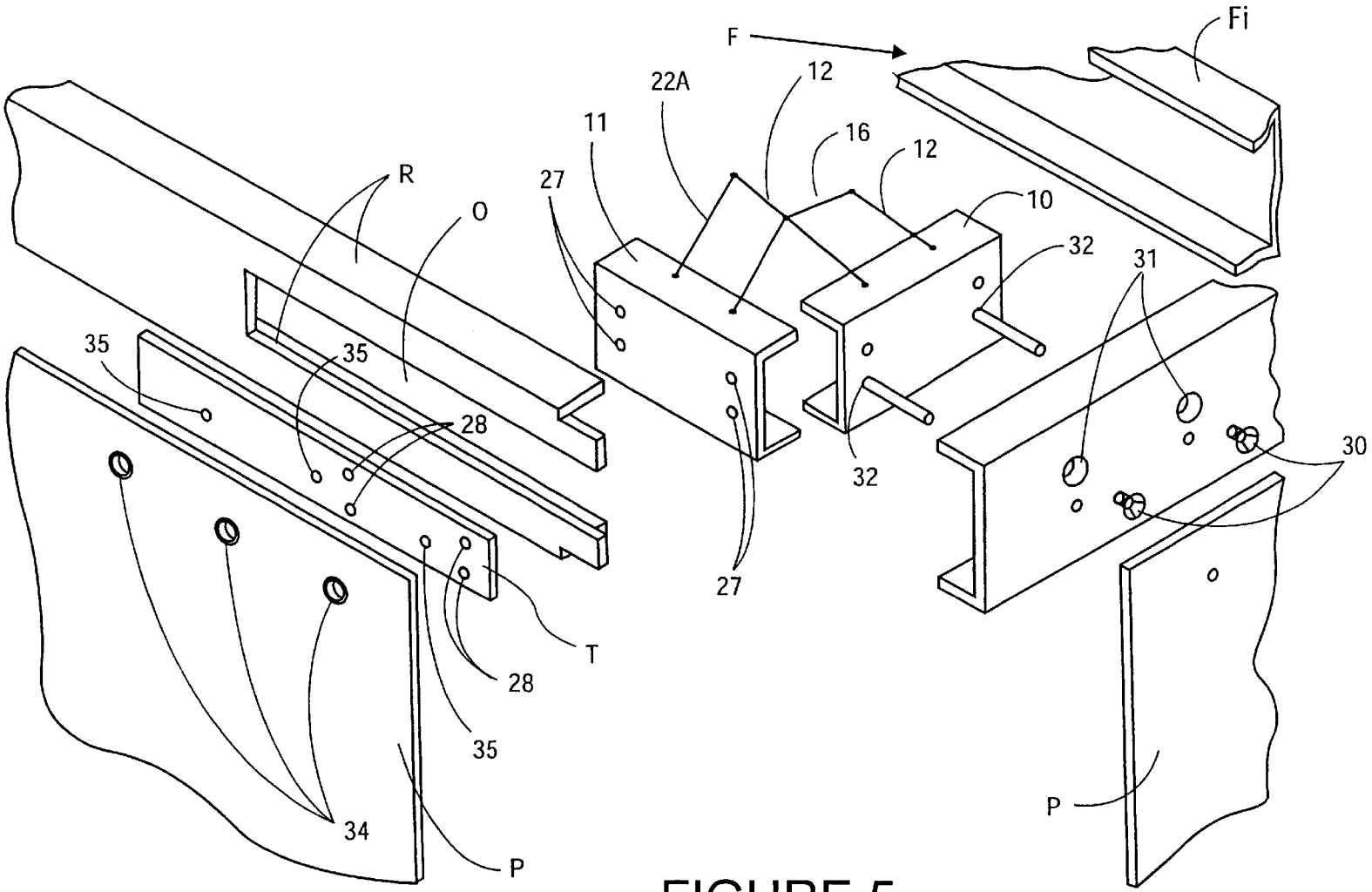
FIG. 5 is a partial exploded view of the arrangement in FIG. 4.

According to one form of a display case in which the invention is particularly useful a top frame F of substantially channel sections F' are provided. Across the front of the display case where the opening is located the ends of side frame members F' are joined by a pair of parallel rails R. As can be seen in FIG. 5, openings 31 are formed in the side frame member F' through which fastenings 30 engage into openings 32 in the frame mounting element 10. The space O between the rails R provides a clear area through which the arms of the hinge can move during opening and closing of the panel P.

The bottom flanges of frame elements F' and the bottom rail R of the pair of rails provide a ledge on which a panel can sit such that the frame F and the hinge mechanisms are not readily seen. The panel can be opaque or, in a preferred form, of frosted glass so that top lighting can be provided.

In like manner, the flanges of similar rails and frame members at the lower end of the display case can provide a mounting for a display board or the like, thereby once again hiding from view the hinges and frame.

In the illustrated form in FIG. 5 a panel P' is mounted by the top and bottom frames though in one form of a display case such panels are not present so that there is no physical division between display areas behind the glass panel P. Therefore, visually, all that will be seen is the series of adjacent panels P, each one of which is pivotally openable.

The geometry of the hinge is such that as the panel is opened the panel moves outwardly away from the dust seals so that the hinged side of the panel is moved clear of the dust seal and therefore does not cause damage to the seal as the panel is further opened toward its fully open position. Likewise, as the panel is closed the panel moves towards its closing position such that it is aligned substantially parallel to the plane of the opening and then is finally pulled in onto the seals so as to once again not cause any damage to the seals yet apply a sealing pressure over the entire extent of the seals about the opening.

Figure 6:
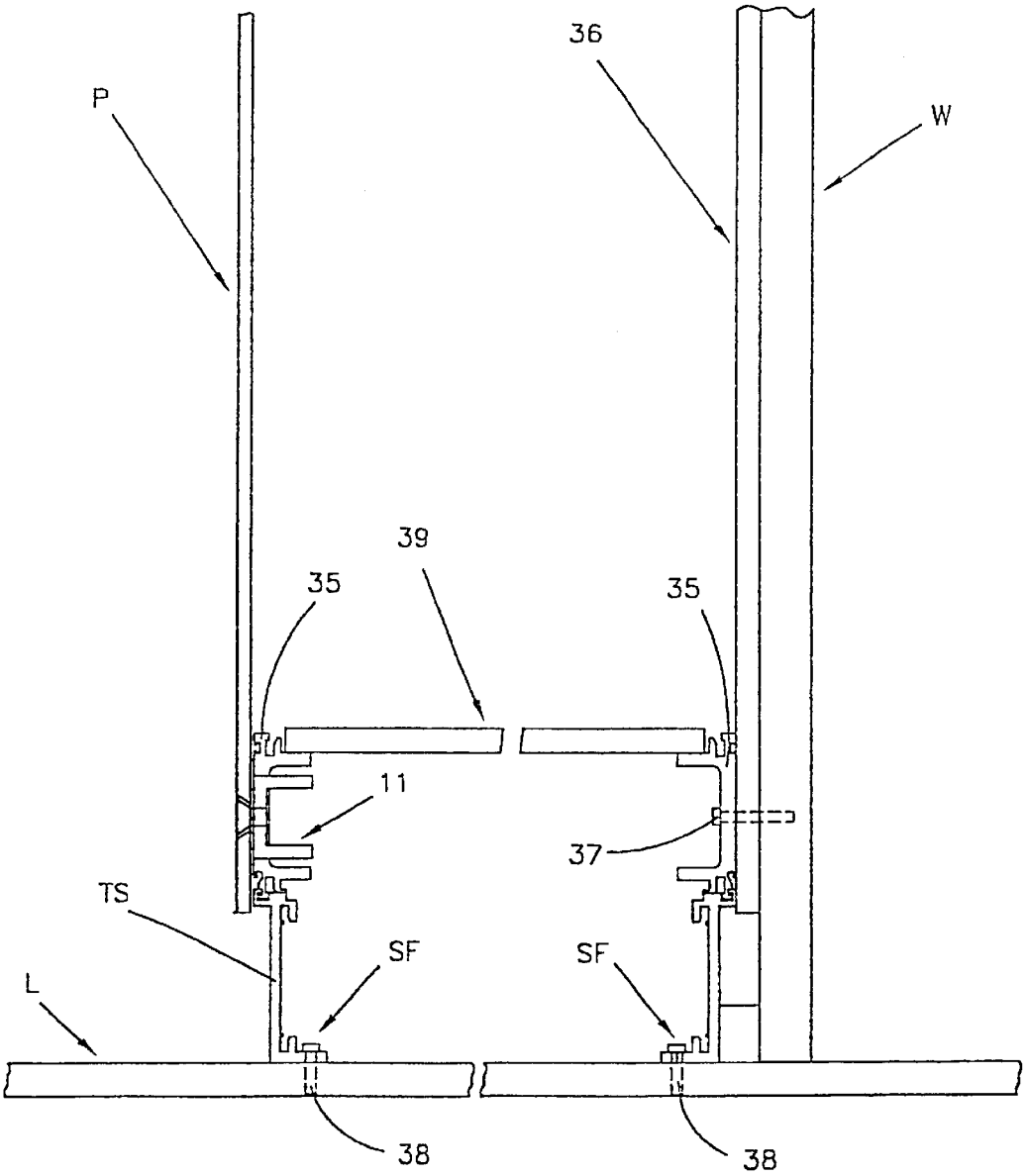
FIG. 6 is a cross-sectional view of a lower part of a display case incorporating the hinge of the present invention.

Referring to FIG. 6, there is shown a further form of display case construction in which the hinge of the present invention can be incorporated. The display case is of a type where it is mounted with a wall W. The frame F is formed by the joining at mutual right angles of frame sections 35 which are of extruded alloy. In FIG. 6 only the front and back extrusions 35 are shown. A back panel 36 is mounted with the wall W and the back extrusion 35 is bolted in place by bolts 37 extending through the base of the extrusion 35 through the back panel 36 and into wall W. The frame F is supported by a sub-frame SF which is bolted by bolts 38 to the floor L. As can be seen the sub-frame SF provides a toe recess TS adjacent the lower edge of the glass panel P.

A cut-out is provided in the base of the front extrusion 35 to accommodate the panel mounting member 11 of the hinge. A base board 39 is supported on ledges formed by the legs of the generally channel shaped extrusion 35.

Figure 7:
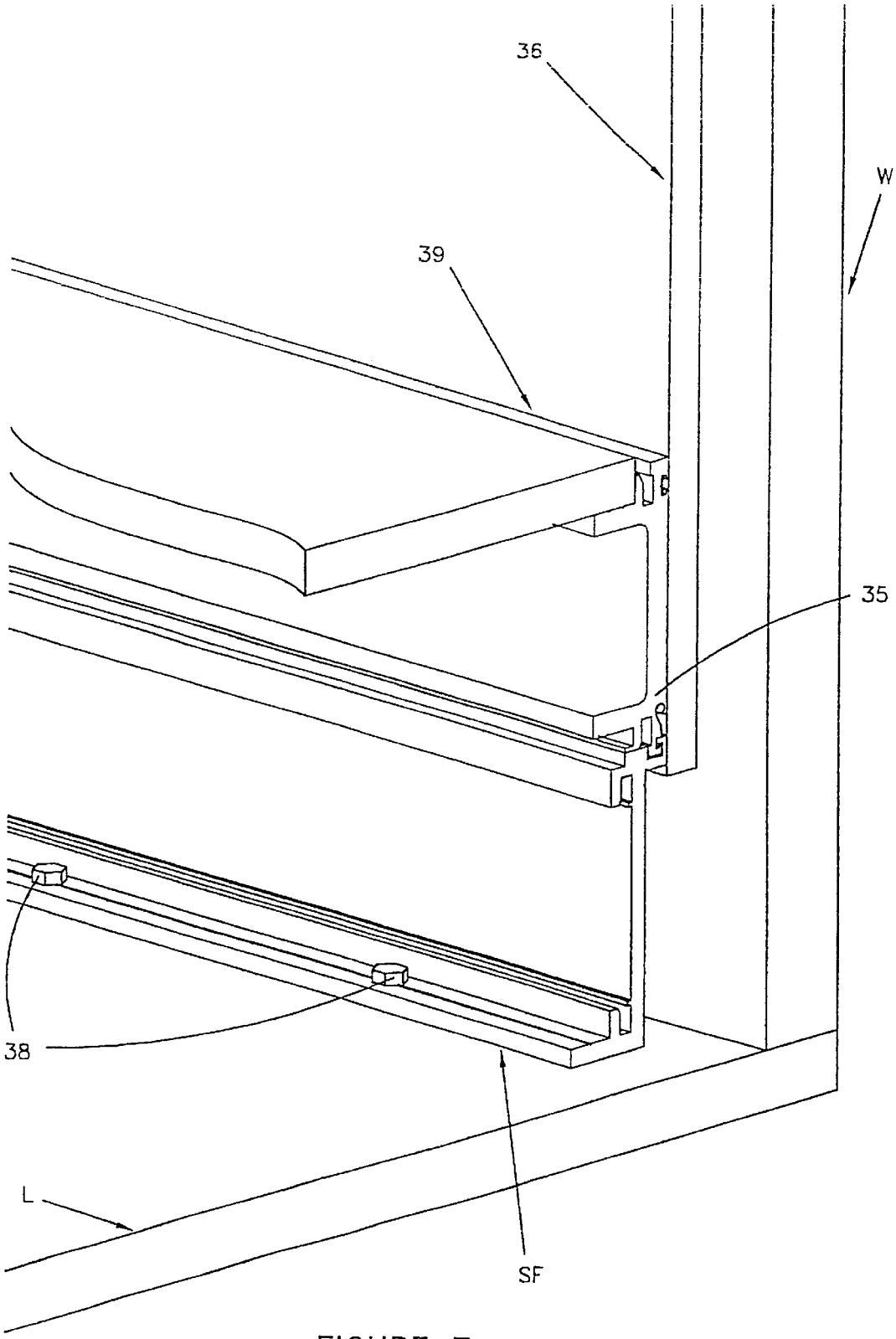
FIG. 7 is a detailed view of the back wall mounting of the lower frame arrangement as shown in FIG. 6.

The mounting arrangement with the back wall W is more particularly shown in FIG. 7. This illustrates how the lower frame F is bolted to the wall and the sub-frame SF can be slid onto the lower frame and then itself bolted via bolts 38 to the floor L.

Figure 8:
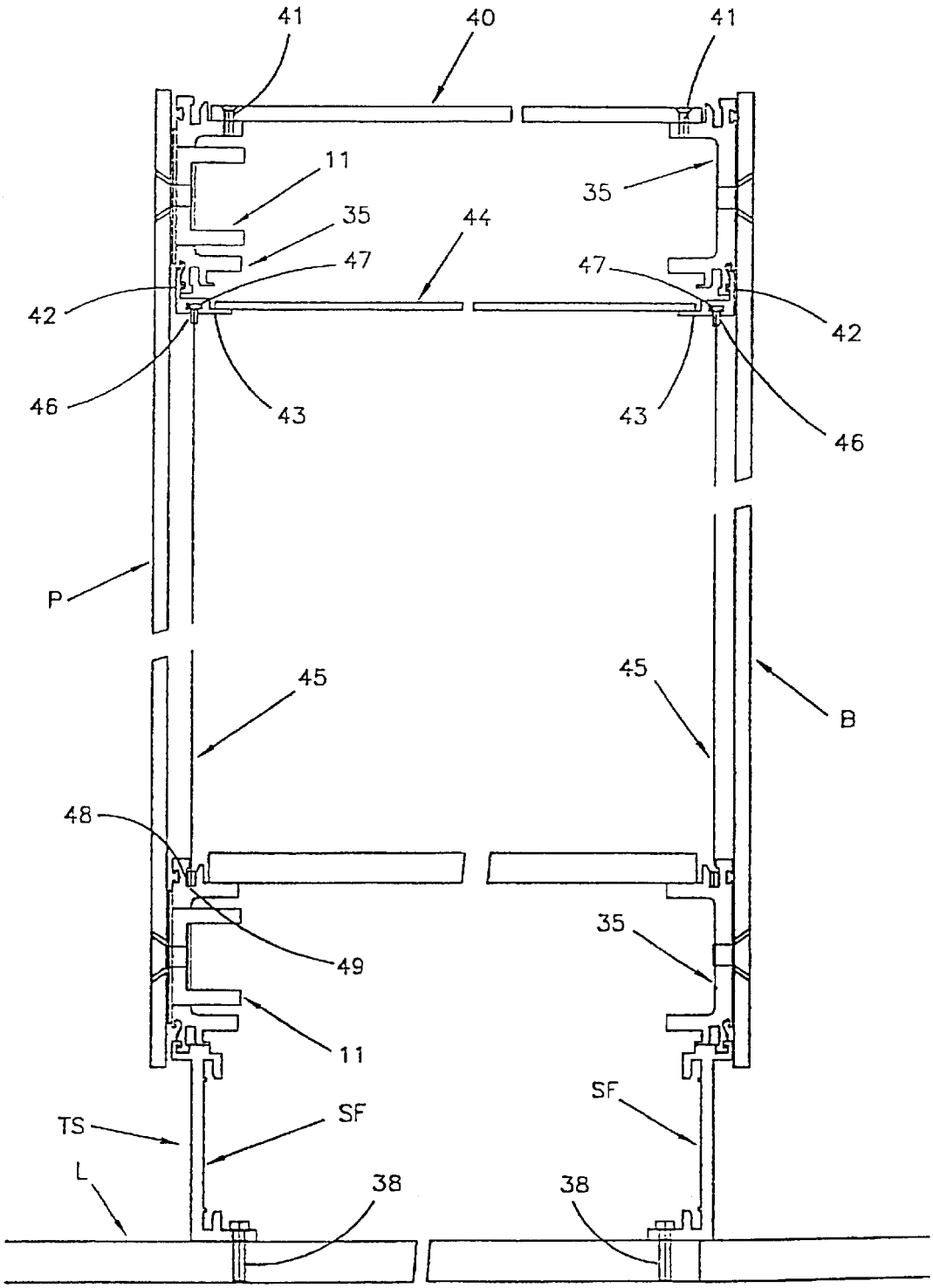
FIG. 8 is a cross-sectional view of a display case incorporating the hinge of the present invention where the display case incorporates a glass back panel and a suspension system.

As shown in FIG. 8, the top frame F is similarly constructed. In place of the base board 39 an acrylic panel is mounted to the ledges formed by the upper legs of the extrusions 35, this acrylic panel being fastened in place by mechanical fasteners 41 to provide rigidity of the top frame F.

As also shown in FIG. 8, sub extrusions 42 are engaged with the lower portion of main extrusions 35. The sub extrusions 42 provide a ledge 43 on which a diffuser panel 44 can be engaged. This diffuser panel 44 not only provides a means of hiding the top frame F and hinge but also provides for diffusing light when a light fitting is located in the upper portion of the display case.

FIG. 8 also illustrates a display case where the back panel B is formed of glass, eg a display case which can be of free standing form. The bottom frame detail and mounting is the same as that shown in FIG. 6 except the back panel B is not mounted to a supporting wall or other structure.

Also shown in FIG. 8 is a cable suspension system where a cable 45 extends downwardly from an anchor 46 engaged in a groove 47 in sub extrusion 42. Likewise the lower end of the cable 45 is anchored at 48 in a groove 49 in the main extrusion 35 of the bottom frame F. The cables 45 thus provide a mounting point for, say, shelves or other display elements within the display case.

Figure 9:
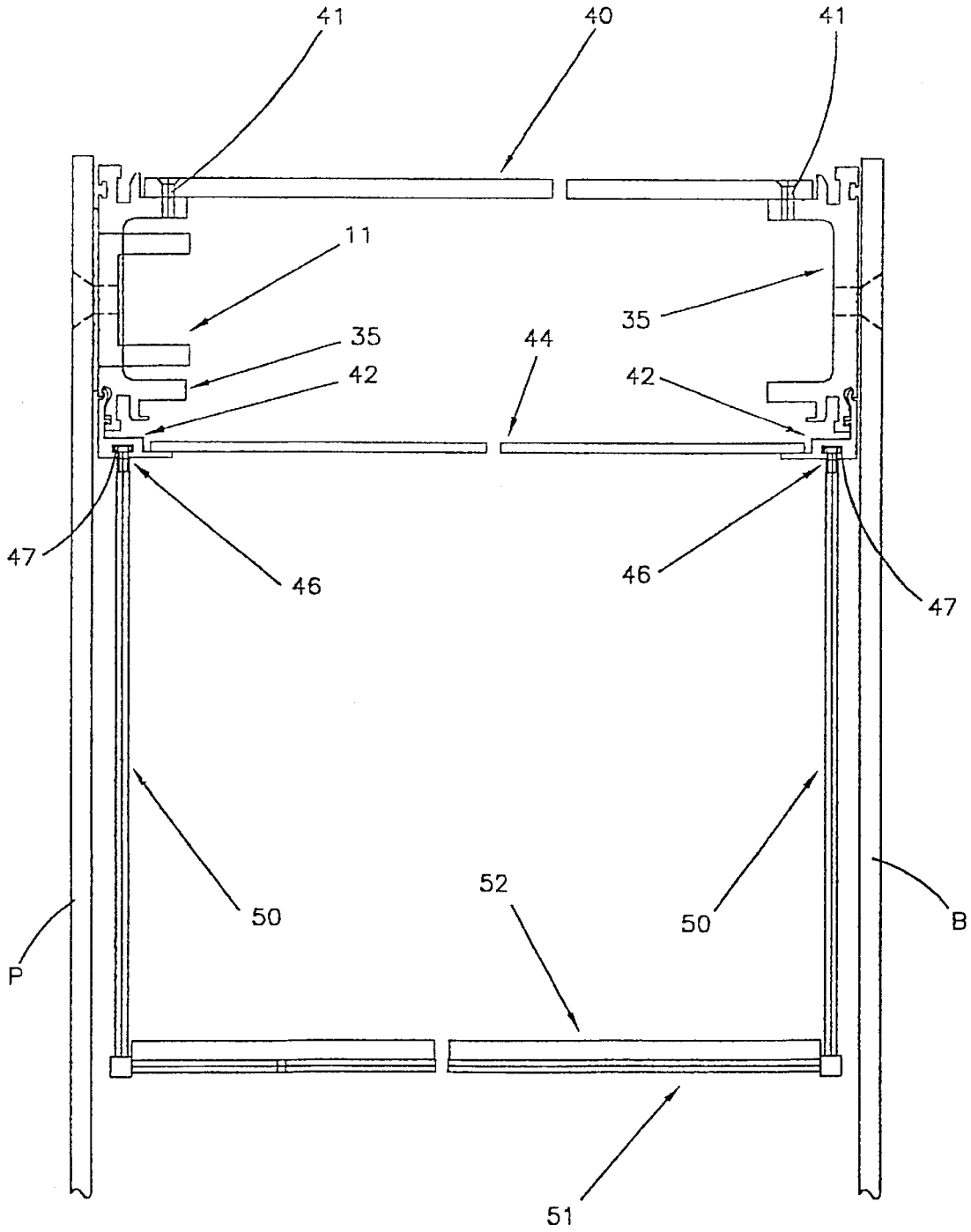
FIG. 9 is a cross-sectional view of a display case of the type shown in FIG. 8 but with a suspended glass shelf arrangement.

A further arrangement is shown in FIG. 9 where vertical supports 50 project downwardly from the anchors 46. Extending between the vertical supports 50 is a horizontal support 51. A glass shelf 52 can thus be located and supported by a pair of suspended horizontal supports 51.

Figure 10:
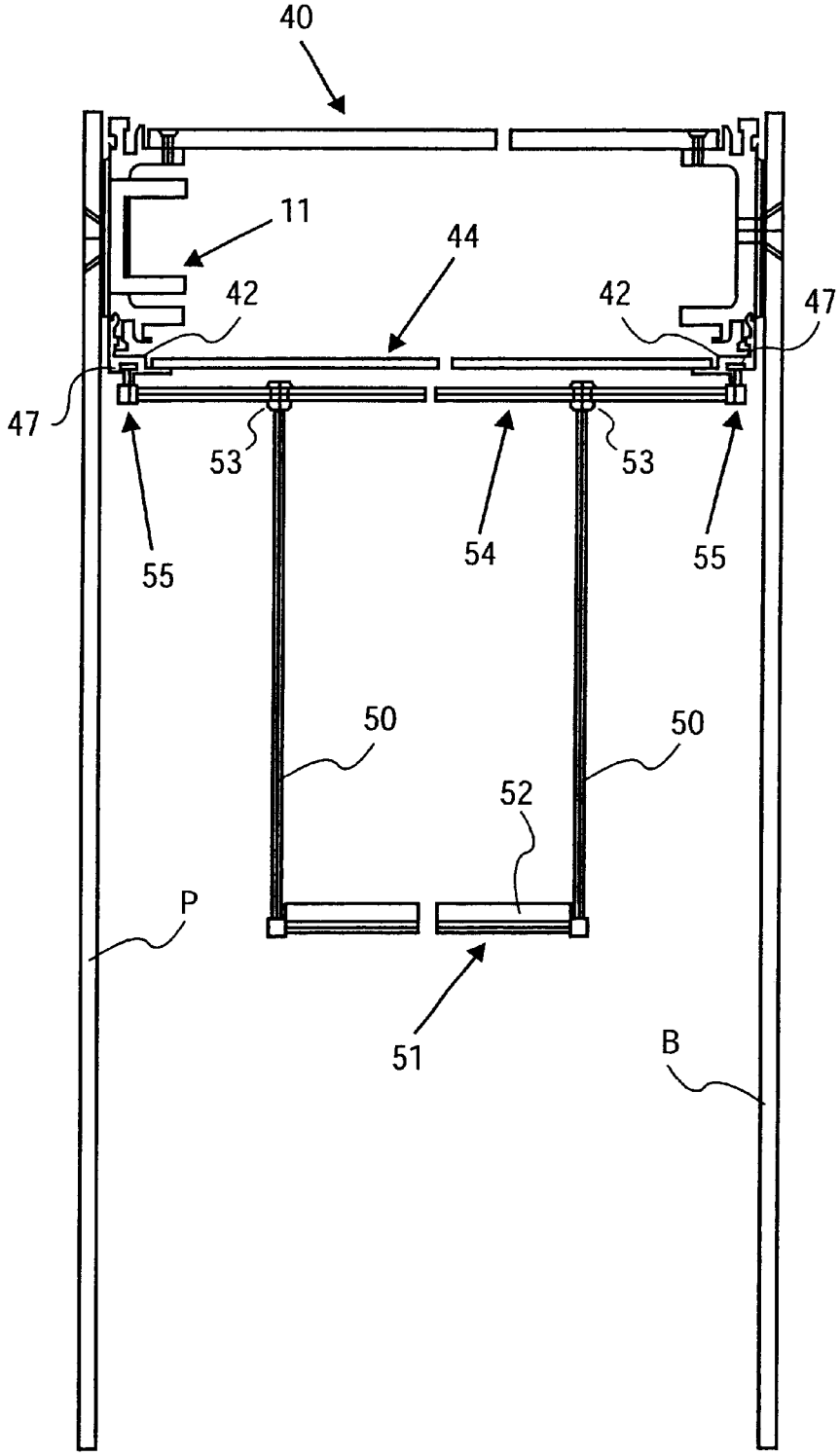
FIG. 10 is a similar view to FIG. 9 but showing a different form of suspended glass shelf.

In yet a further arrangement in FIG. 10 the vertical supports 50 are mounted by sliding attachments 53 to a horizontal support 54 which is carried by sliding attachments 55 mounted by grooves 47 of the sub extrusions 42. Thus different sized shelves 52 and positioning of the shelf can be readily achieved.

Figure 11:
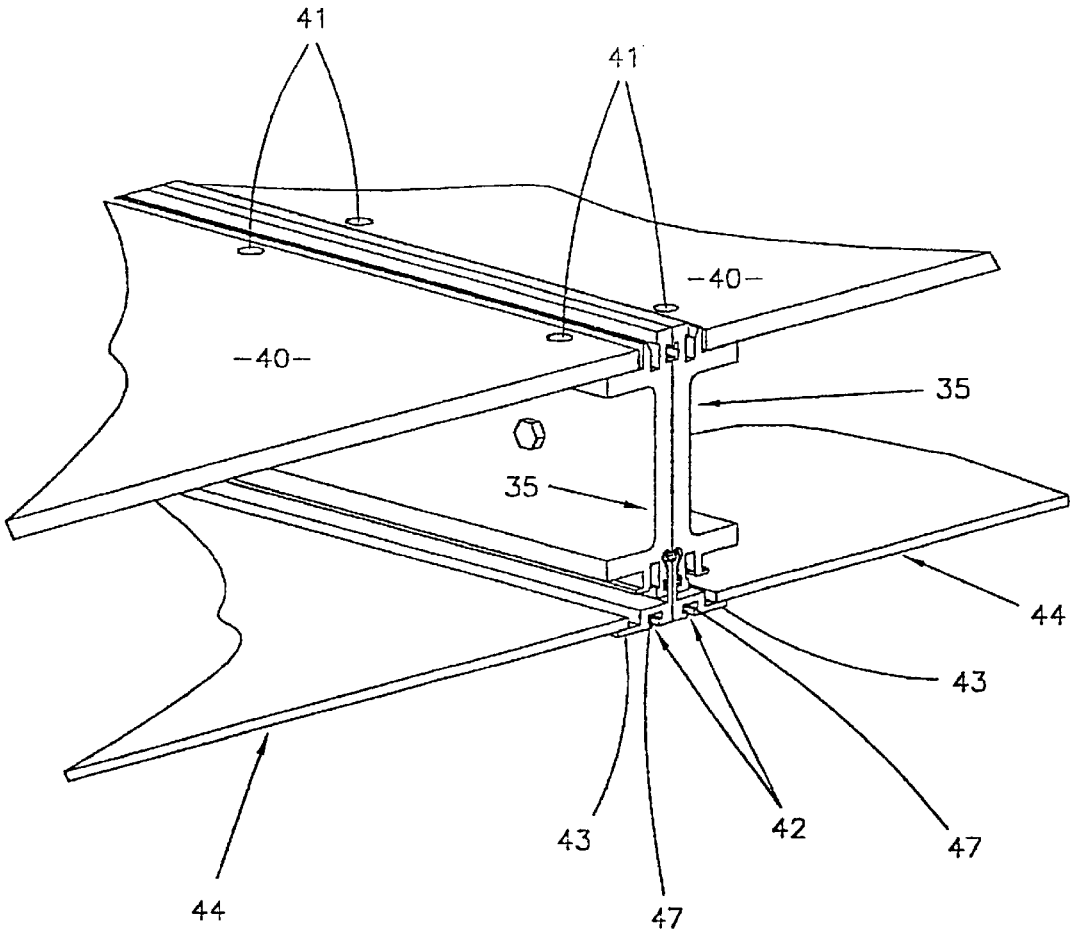
FIG. 11 is a detailed perspective view of the coupling of upper frames of adjacent show cases.

Display cases can be located adjacent one another and to this end FIG. 11 shows the bolting together of extrusions 35 of the upper frames of adjacent display cases. Thus, display cases either free standing or mounted as shown in FIGS. 6 and 7 with a wall or some structural component located side by side provide an apparently continuous front glass panel. Not only is this aesthetically pleasing in appearance but provides interesting display options.

The hinge according to the present invention thus provides a suitable hinge mechanism for carrying heavy panels of glass, e.g. in the range of, say, 100–200 kg. or glass panels of the general sizes found in big display cases, e.g. 3 meters×1 meter and 2 meters×2 meters. The hinge not only provides the necessary support to provide good control of the panel as it moves between open and closed positions, but also provides degrees of adjustability. The hinge also ensures that the panel closes correctly against dust seals and, furthermore, does not create damage to the dust seals during the initial opening and final closing of the panel.

What is claimed is:

1. A hinge including a panel mounting element (11) and a fixture mounting element (10), a first arm (16) pivotally mounted (19) to the panel mounting element (11) and a second arm (12) pivotally mounted (15) to the fixture mounting element (10), the first and second arms being pivotally joined together by pivot means (20) and length adjustable adjustment means **(22, 22*a*)** coupling each arm to the mounting element opposite to that to which it is pivotally coupled.

2. A hinge as claimed in claim 1 wherein the mounting elements (10, 11) are each of channel shape with the arm (12, 16) coupled thereto being pivotally mounted (15, 19) between the flanges of the channel shape.

3. A hinge as claimed in claim 2 wherein one of the first and second arms (12, 16) has a space through which the other of the first and second arms extends such that the arms intersect, the pivot means (20) being located at the intersection of the arms.

4. A hinge as claimed in claim 2 wherein the first and second arms (12, 16) intersect and the pivot means (20) is located at the intersection of the arms.

5. A hinge as claimed in claim 1 wherein said adjustable adjustment means **(22, 22*a*) is coupled to each arm at a position more remote from the pivot coupling (15, 19) of the arm to the mounting element (10, 11) than the pivot means (20)**.

6. A hinge as claimed in claim 1 wherein the adjustable adjustment means **(22, 22*a*) is a length adjustable link each end thereof having a ball union (21, 23; 21*a*, 23*a*) coupled via a pivot mount (26, 26*a*) to the respective arm (12, 16) and mounting element (10, 11) the adjustable link (22, 22*a*) having locking means (25, 25*a*)** for locking the link at an adjusted length.

7. A hinge as claimed in claim 1 wherein the panel mounting element (11) is coupled to the first arm (16) by further adjustment means (56, 57).

8. A hinge as claimed in claim 1 or 7 wherein the panel mounting element (11) includes a mounting surface **(11*a*) engagable with a surface of a panel (P), said panel (P) being connectable to the panel mounting element (11) by fasteners (33) located through openings (34) in the panel and anchoring with said panel mounting element (11)**.

9. A display cabinet including a closure panel (P), a pair of hinges mounting said closure panel such that the closure panel is movable between open and closed positions each said hinge having a panel mounting element (11) coupled to the closure panel and a fixture mounting element (10) coupled to a fixture (W), the mounting elements (10, 11) being coupled together by first and second arms (12, 16), said mounting elements each having a pair of projecting flanges (14, 18) between which said arms (12, 16) are pivotally and adjustably coupled, and length adjustable adjustments means coupling said arms to said mounting elements.

10. A display cabinet as claimed in claim 9 wherein the first arm (16) of the hinge is pivotally mounted to the panel mounting element (11) and the second arm (12) is pivotally mounted to the fixture mounting element (10), said first and second arms (16, 12) crossing over in their length and coupled by a pivot means (20) at the crossover.

11. A display cabinet as claimed in claim 10 wherein said adjustable adjustment means (22, 22*a*) extending between each mounting element (10, 11) and that arm (16, 12) which is pivotally coupled to the other mounting element, said adjustable adjustment means provided to allow said arms (12, 16) to be adjustably coupled to said mounting elements.

12. A display cabinet as claimed in claim 11 wherein the coupling (26) of the adjustment means (22, 22*a*) to the arm (12, 16) is beyond the pivot means (20) relative to the coupling of the arm (12, 16) to the mounting element (10, 11) to which the arm is pivotally coupled.

13. A display cabinet as claimed in claim 12 wherein the adjustable adjustment means (22, 22*a*) is a length adjustable link with locking means (25, 25*a*) to lock the link in an adjusted length.

14. A display cabinet as claimed in claim 9 wherein the panel mounting element (11) includes a mounting surface (11*a*) against which the panel (P) is to be engaged, a plurality of headed mechanical fasteners (33) being located through openings (34) in the panel such that the head engages with the panel and a shank of each fastener anchors in the panel mounting element to thereby mount the panel with the panel mounting element.

15. A display cabinet as claimed in claim 14 wherein masking means (C) is provided to mask from view through the panel (P), said panel being transparent, the hinges.

16. A display cabinet as claimed in claim 9 further including a top frame (F) and a bottom frame (F), said top frame (F) and said bottom frame (F) each having openings (O) through which at least one of the arms (12, 16) of each hinge can extend.

17. A display cabinet as claimed in claim 16 wherein the fixture mounting element (10) forms part of one of said top frame (F) and said bottom frame (F).

18. A display cabinet as claimed in claim 9 wherein said bottom frame (F) includes mounting means for a floor (39).

19. A display cabinet as claimed in claim 18 further including a support means (SF) to support the bottom frame (F) from a floor surface (L).

20. A display cabinet as claimed in claim 16 wherein the top frame (F) includes means to receive a cover panel (40).

21. A display cabinet as claimed in claim 16 wherein the top frame (F) includes anchor means (4*b*) for anchoring suspension means (50) to suspend one or more shelves (52) within the cabinet.

22. A display cabinet as claimed in claim 16 wherein the top frame (F) includes anchor means (4*b*), a plurality of suspension means (50) anchored by the anchor means and at least one shelf (52) suspended within the cabinet by said suspension means (50).

23. A display cabinet as claimed in claim 22 wherein the top frame (CF) includes ceiling mounting means (46), a ceiling panel (44) being located within the cabinet by said ceiling mounting means to hide from view said top frame (F).

24. A hinge including a first mounting element (10) and a second mounting element (11); a first arm (12) pivotally mounted to the first mounting element (10), a second arm (16) pivotally mounted to the second mounting element (11), the first and second arms intersecting and pivotally joined by pivot means (20), a first link (22) pivotally and adjustably connected between the first mounting element (10) and the second arm (16) and a second link (22*a*) pivotally and adjustably connected between the second mounting element (11) and the first arm.

25. A hinge as claimed in claim 24 wherein the first and second links (22 and 22*a*) are respectively coupled to the second and first arms (15 and 11) at pivot locations (26) which are more remote from the pivot coupling (15, 19) of each of first and second arms to the first and second mounting elements than the pivot means (20).

26. A hinge as claimed in claim 25 wherein first and said second links (22, 22*a*) are adjustable in length.

27. A hinge as claimed in claim 24 wherein the arms (12 and 16) are formed from spheroidal graphite cast iron and the pivots (15, 19, 20) include a pivot pin of nitrated steel.

* * * * *